United States Patent [19]

Finter

[11] Patent Number: 5,032,488

[45] Date of Patent: Jul. 16, 1991

[54] METHOD OF METALIZING A SURFACE USING A MIXTURE OF OLEFIN AND DIBENZALACETONE PALLADIUM COMPLEX

[75] Inventor: Jürgen Finter, Freiburg, Fed. Rep. of Germany

[73] Assignee: Ciba-Geigy Corporation, Ardsley, N.Y.

[21] Appl. No.: 165,448

[22] Filed: Mar. 1, 1988

Related U.S. Application Data

[63] Continuation of Ser. No. 895,978, Aug. 13, 1986, abandoned.

[30] Foreign Application Priority Data

Aug. 23, 1985 [CH] Switzerland ..... 3645/85

[51] Int. Cl.[5] ..... G03C 1/492

[52] U.S. Cl. ..... 430/270; 430/281; 430/283; 430/284; 430/285; 430/324; 430/325; 430/423; 430/424; 522/34; 522/66; 522/152

[58] Field of Search ..... 430/423, 424, 324, 325, 430/270, 281, 283, 284, 285; 522/34, 66, 152

[56] References Cited

U.S. PATENT DOCUMENTS 3,295,974 1/1967 Erdmann .
3,993,807 11/1976 Stabenow et al. .
4,347,232 8/1982 Michaelson .

FOREIGN PATENT DOCUMENTS 125617 11/1984 European Pat. Off. .

OTHER PUBLICATIONS

Hackh's Chemical Dictionary.
T. Takahashi, J. Chem. Soc., Chem Comm. 1970, 1065.
Kirk-Othmer, *Encyclopedia of Chemical Technology*, Third Ed., vol. 17, John Wiley & Sons, New York, pp. 540-599 (1982).

*Primary Examiner*—Jack T. Brammer
*Attorney, Agent, or Firm*—Harry Falber

[57] ABSTRACT

When irradiated, a mixture of (a) a non-volatile substance containing at least one olefinic double bond and (b) a dibenzalacetone palladium complex deposits zero-valent palladium. Electrically non-conductive carrier materials which have been coated with a layer of said mixture can, after irradiation, be metallized by metal deposition without current, with electrically conductive coatings or patterns being obtained.

13 Claims, No Drawings

METHOD OF METALIZING A SURFACE USING A MIXTURE OF OLEFIN AND DIBENZALACETONE PALLADIUM COMPLEX

This application is a continuation of application Ser. No. 895,978, filed Aug. 13, 1986, now abandoned.

The invention relates to a mixture of (a) at least one non-volatile substance containing at least one olefinic double bond and (b) at least one dibenzalacetone palladium complex and to the use thereof for metal deposition without current.

It is known from German Offenlegungsschrift No. 24 51 217 that solutions of complexes of palladium, triphenyl phosphite and an olefinically or acetylenically unsaturated organic compound containing 3 to 16 carbon atoms or of palladium dibenzalacetone complexes may be employed for metal deposition without current on substrates such as metals, oxidised metals and plastics. The substrates to be coated are dipped one or more times in a solution of the palladium complexes, preferably in benzene or toluene solutions, and heated to 100°-300° C., with palladium being deposited on the substrate surface. The substrates so coated are suitable for metal deposition without current. Mixtures of polymers and palladium complexes are described in published European patent application No. 0 125 617. Zerovalent palladium is formed when such mixtures are subjected to heat treatment.

The invention relates to a mixture which contains a) at least one non-volatile substance containing at least one olefinic double bond and b) at least one palladium complex of formula I

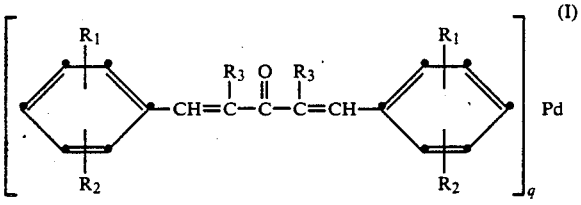

(I)

wherein $R_1$ is $HO—C_mH_{2m}—O)_n$, in which m is a value from 2 to 6 and n is a value from 0 to 20, or $R_1$ is $—O—CH_2-CHOHCH_2OH$ or

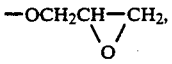

or $R_1$ has, independently, the meaning of $R_2$, $R_2$ is a hydrogen atom, $C_1$-$C_4$alkyl, $C_1$-$C_4$alkoxy, halogen, $C_6$-$C_{10}$aryl, $C_7$-$C_8$aralkyl or $C_7$-$C_8$alkaryl, $R_3$ is a hydrogen atom or $C_1$-$C_4$alkyl, or both substituents $R_3$ taken together form a polymethylene chain containing 2 to 4 carbon atoms and q is a rational number from 1 to 3.5.

In the $HO—C_mH_{2m}—O)_n$ group m is preferably a value from 2 to 4 and n is preferably a value from 0 to 10, most preferably from 0 to 6. The $C_mH_{2m}$ group is preferably ethylene, 1,2- or 1,3-propylene or 1,4-butylene.

The compounds of formula I may also be present in the form of mixtures of palladium complexes, in which case each symbol q has a different meaning. q is preferably a rational number from 2 to 3.5.

Alkyl and alkoxy groups $R_2$ and alkyl groups $R_3$ may be straight chain or branched, e.g.: methyl, ethyl, n-propyl, isopropyl, n-butyl and sec-butyl; methoxy, ethoxy, n-propoxy, n-butoxy and sec-butoxy. Halogen atoms $R_2$ are preferably bromine and chlorine atoms. $R_2$ as aryl is for example 1- or 2-naphthyl and, preferably, phenyl. Examples of aralkyl or alkaryl groups $R_2$ in accordance with the definition are benzyl, α- and β-phenylethyl, methylbenzyl, tolyl, xylyl and ethylphenyl.

Each of $R_2$ and $R_3$ is preferably a hydrogen atom.

$R_1$ is preferably attached in the m,m'-position and most preferably in the p,p'-position, with the preferred meanings of $R_1$ being H, OH or

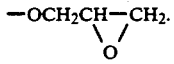

Particularly preferred compounds of formula I are those wherein $R_1$ is H, OH or

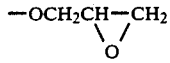

and each of $R_2$ and $R_3$ is a hydrogen atom.

The compounds of formula I can be prepared by methods which are known per se (q.v. e.g. J. Chem. Soc. D 1970, 1065 and U.S. Pat. No. 4,347,232) by reacting q moles of a compound of formula II

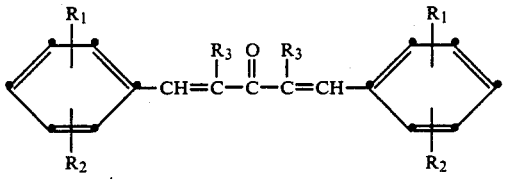

(II)

with a soluble palladium salt, in the presence of a base and, optionally, of a hydrogen donor. $R_1$, $R_2$, $R_3$ and q are as defined for formula I.

Examples of suitable bases are the alkali metal salts of aliphatic monocarboxylic acids, in particular potassium acetate and sodium acetate. Examples of suitable palladium salts are $PdBr_2$, $PdCl_2$ and $Na_2PdCl_4$, with $Na_2PdCl_4$ being particularly preferred and $PdCl_2$ being most preferred. The reaction is conveniently carried out in an organic solvent which simultaneously acts as hydrogen donor. Examples of suitable solvents are alkanols containing up to 6 carbon atoms, with ethanol being preferred and methanol being most preferred.

The compounds of formula II are known or can be prepared in a manner known per se, e.g. by a method analogous to that described in U.S. Pat. No. 3,295,974.

The weight ratio of component (a) to component (b) in the mixture of this invention may be in the range from 100:1 to 1:20, preferably from 10:1 to 1:10, in particular from 5:1 to 1:5, most preferably from 3:1 to 1:3.

Suitable components (a) are monomeric, oligomeric and polymeric substances which contain at least one olefinic double bond. They may be liquid, liquid-viscous or solid. Liquid and liquid-viscous substances are conveniently employed together with a binder.

The component (a) may be e.g. a $C_5$-$C_{20}$alkene, a $C_5$-$C_{12}$cycloalkene, an olefinically unsaturated alcohol or amide containing 3 to 12 carbon atoms, an olefinically unsaturated carboxylic acid or carboxylic acid derivative containing 3 to 30 carbon atoms, a polybutadiene or polyisoprene, an unsaturated polyester or a polymer containing olefinic side groups.

Component (a) is preferably an acrylate, methacrylate, acrylamide or methacrylamide; or a maleate, maleic anhydride, maleimide or maleamide, each unsubstituted or substituted by $C_1$–$C_4$alkyl; or an allyl ether or allylamide, a polymaleate, a polybutadiene or polyisoprene or a polyolefin containing dimethylmaleimide groups as side groups. Component (a) is most preferably a polybutadiene or polyisoprene which is functionalised with amino, hydroxyl or carboxyl groups and has a molecular weight in the range from 5,000 to 40,000, preferably from 10,000 to 40,000.

The alkene preferably contains 5 to 12 carbon atoms and 1 to 3 double bonds. Examples are pentene, pentadiene, hexene, hexadiene, heptene, octene, decene and dodecene.

Examples of cycloalkene are cyclopentene, cyclopentadiene, cyclohexene, cyclohexadiene, cycloheptene, cycloheptatriene, cyclooctene, cyclooctadiene cyclooctatriene, cyclodecene and cyclododecene.

Olefinically unsaturated alcohols or amides preferably contain 3 to 6 carbon atoms, with allyl alcohols and allylamides being preferred. Allyl ethers preferably containing 4 to 12 carbon atoms and allyl esters preferably containing 5 to 12 carbon atoms are also suitable.

Unsaturated carboxylic acids or carboxylic acid derivatives preferably contain 3 to 18 carbon atoms. Such acids may be mono- or polycarboxylic acids preferably containing 1 to 3 carboxyl groups. Examples of such carboxylic acids are acrylic acid, methacrylic acid, crotonic acid, maleic acid, methylmaleic acid, dimethylmaleic acid and fumaric acid. Suitable derivatives are esters preferably containing 1 to 12 carbon atoms in the ester group, and also amides, anhydrides and imides. The amides and imides may be substituted by $C_1$–$C_{12}$alkyl.

Preferred esters are acrylates and methacrylates of alcohols containing 1 to 12 carbon atoms and, preferably, 1 to 6 hydroxyl groups. Suitable alcohols are $C_1$–$C_{12}$alkanols, $C_2$–$C_6$alkanediols, trimethylolpropane, pentaerythritol, poly(oxaalkylene)diols containing 2 to 6 carbon atoms in the alkylene group, bisphenols and novolaks. Further suitable esters are the reaction products of glycidyl compounds with acrylic or methacrylic acid.

The polybutadienes or polyisoprenes may be oligomeric or polymeric homo- or copolymers. Suitable monomers for the copolymers are in particular acrylonitrile and styrene.

Suitable unsaturated polyesters are derived in particular from maleic acid and $C_2$–$C_{18}$diols.

The polymers containing olefinic side groups may be for example those polymers containing an acrylic or methacrylic group as side group. Examples are esters of polyvinyl alcohol or polyacrylic acid or methacrylic acid which are esterified with acrylic acid alkane-diole monoesters or methacrylic acid alkanediol monoesters. Further suitable polymers containing an olefinic side group are those which contain a maleimidyl group of the formula

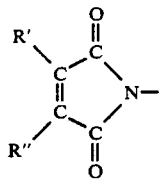

wherein each of R′ and R″ independently of the other is e.g. a hydrogen atom or $C_1$–$C_4$alkyl. Such polymers are described e.g. in U.S. Pat. No. 4,079,041.

The component (a) may also possess the function of a binder. The mixture of the present invention may additionally contain a binder. Such mixtures preferably contain 99.8 to 40% by weight, in particular 99 to 60% by weight, most preferably 90 to 70% by weight, of binder, 0.1 to 30% by weight, in particular 0.5 to 20% by weight, most preferably 5 to 15% by weight, of component (a), and 0.1 to 30% by weight, in particular 0.5 to 20% by weight, most preferably 5 to 15% by weight, of component (b).

The binder may be a thermosetting or thermoplastic polymer, e.g.:

1. Polymers, which are derived from hydrocarbons having single or double unsaturation, such as polyolefins, e.g. polyethylene which can be uncrosslinked or crosslinked, polypropylene, polyisobutylene, polymethylbut-1-ene, polymethylpent-1-ene, polybut-1-ene, polyisoprene, polybutadiene, polystyrene, polyisobutylene, copolymers of the monomers on which the above homopolymers are based, such as ethylene/propylene copolymers, propylene/but-1-ene copolymers, propylene/isobutylene copolymers, and terpolymers of ethylene and propylene with a diene, for example hexadiene, dicyclopentadiene or ethylidene-norbonene; mixtures of the above homopolymers, for example mixtures of polypropylene and polyethylene, polypropylene and polybut-1-ene, polypropylene and polyisobutylene.

2. Halogen-containing vinyl polymers, such as polyvinyl chloride, polyvinylidene chloride, polyvinyl fluoride, as well as polychloroprene and chlorinated rubbers.

3. Polymers which are derived from $\alpha,\beta$-unsaturated acids and their derivatives, such as polyacrylates and polymethacrylates, polyacrylamides and polyacrylonitrile, as well as their copolymers with other vinyl compounds, such as acrylonitrile/butadiene/styrene, acrylonitrile/styrene and acrylonitrile/styrene/acrylate copolymers.

4. Polymers which are derived from unsaturated alcohols and amines and their acyl derivatives or acetals, such as polyvinyl alcohol, polyvinyl acetate, polyvinyl stearate, polyvinyl benzoate and polyvinyl maleate, polyvinyl butyral, polyallyl phthalate, polyallyl melamine and their copolymers with other vinyl compounds, such as ethylene/vinyl acetate copolymers.

5. Homo- and copolymers which are derived from epoxides, such as polyethylene oxide or the polymers which are derived from polyglycidyl compounds.

6. Polyacetals such as polyoxymethylene and polyoxyethylene, and those polyoxymethylenes which contain ethylene oxide as comonomer.

7. Polyphenylene oxides.

8. Polyurethanes, polyimides and polyureas.

9. Polycarbonates.

10. Polysulfones.

11. Polyamides and copolyamides which are derived from diamines and dicarboxylic acids and/or from aminocarboxylic acids or the corresponding lactams, such as polyamide 6, polyamide 6/6, polyamide 6/10, polyamide 11, polyamide 12.

12. Crosslinked polymers which are derived from aldehydes on the one hand and from phenols, ureas and melamines on the other, such as phenol/formaldehyde, urea/formaldehyde and melamine/formaldehyde resins.

13. Alkyd resins, such as glycerol phthalic acid resins and their mixtures with melamine formaldehyde resins.

14. Unsaturated polyester resins, which are derived e.g. from copolyesters of unsaturated and saturated dicarboxylic acids with polyhydric alcohols, as well as vinyl compounds as crosslinking agents.

15. Natural polymers, such as cellulose, rubber, and their chemically modified homologous derivatives, such as cellulose acetates, cellulose propionates and cellulose butyrates, or cellulose ethers such as methyl cellulose.

16. Thermoplastic polyesters, as well as mixtures of the above polymers.

Preferred binders are e.g. an epoxy resin, an unsaturated polyester a polyacrylate or polymethacrylate, a polyimide, a polyurethane, a polyolefin, a polyamide or a polyester.

A particularly preferred binder (c) is an epoxy resin or an epoxy resin mixture containing (d) a thermoactivatable hardener and/or curing catalyst.

Suitable epoxy resins (c) are preferably those containing on average more than one group of formula III

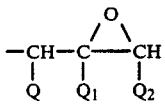

(III)

wherein each of Q and $Q_2$ is a hydrogen atom and $Q_1$ is a hydrogen atom or a methyl group or Q and $Q_2$ together are $—CH_2CH_2—$ or $—CH_2—CH_2—CH_2—$ and $Q_1$ is a hydrogen atom, which group is attached to a hetero atom, e.g. a sulfur atom and, preferably, to an oxygen or nitrogen atom.

Typical examples of such resins are polyglycidyl esters and poly-(β-methylglycidyl) esters which are derived from aliphatic, cycloaliphatic or aromatic polycarboxylic acids. Examples of suitable polycarboxylic acids are: succinic acid, glutaric acid, adipic acid, pimelic acid, suberic acid, azelaic acid, sebacic acid, dimerised or trimerised linoleic acid, tetrahydrophthalic acid, 4-methyltetrahydrophthalic acid, hexahydrophthalic acid, 4-methylhexahydrophthalic acid, phthalic acid, isophthalic acid and terephthalic acid.

Further examples are polyglycidyl ethers and poly(β-methylglycidyl) ethers which are obtained by reacting a compound containing at least two alcoholic and/or phenolic hydroxyl groups per molecule with epichlorohydrin or with allyl chloride, and then epoxidising the reaction product with a peracid.

Examples of suitable polyols are: ethylene glycol, diethylene glycol, poly(oxyethylene) glycols, propane-1,2-diol, poly(oxypropylene) glycols, propane-1,3-diol, butane-1,4-diol, poly(oxytetramethylene) glycols, pentane-1,5-diol, hexane-2,4,6-triol, glycerol, 1,1,1-trimethylolpropane, pentaerythritol and sorbitol; resorcitol, quinitol, bis(4-hydroxycyclohexyl)methane, 2,2-bis(4-hydroxycyclohexyl)propane and 1,1-bis(hydroxymethyl)cyclohex-3-ene; N,N-bis-(2-hydroxyethyl)aniline and 4,4'-bis(2-hydroxyethylamino)diphenylmethane; resorcinol, hydroquinone, bis(4-hydroxyphenyl)methane (bisphenol F), 2,2-bis(4-hydroxyphenyl)propane (bisphenol A), 2,2-bis(4-hydroxy-3,5-dibromophenyl)-propane (tetrabromobisphenol A), 1,1,2,2-tetrakis(4-hydroxyphenyl)ethane, 4,4'-dihydroxybiphenyl, bis(4-hydroxyphenyl)sulfone, as well as novolaks of formaldehyde or acetaldehyde and phenol, chlorophenol or alkylphenols containing up to 9 carbon atoms in the alkyl moiety, preferably cresol and phenol novolaks.

Suitable poly(N-glycidyl) compounds are products obtained by dehydrochlorination of reaction products of epichlorohydrin and amines containing at least two active hydrogen atoms bonded to amino nitrogen atoms. Examples of suitable amines are: aniline, n-butylamine, bis(4-aminophenyl)methane, 1,3- and 1,4-xylylenediamine, 1,3-and 1,4-bis(aminomethyl)cyclohexane and bis(4-methylaminophenyl)methane. Further suitable compounds are: triglycidyl isocyanurate, N,N'-diglycidyl derivatives of cyclic alkylene ureas such as ethylene urea and 1,3-propylene urea, or hydantoins such as 5,5-dimethylhydantoin.

Examples of poly(S-glycidyl) compounds are the di-S-glycidyl derivatives of dithiols such as ethanol-1,2-dithiol and bis(4-mercaptomethylphenyl) ether.

Examples of epoxy resins containing one or more groups of the formula III, wherein Q and $Q_2$ together are a $—CH_2CH_2—$ or $—CH_2CH_2CH_2—$ group are bis(2,3-epoxycyclopentyl) ether, 2,3-epoxycyclopentyl glycidyl ether, 1,2-bis(2,3-epoxycyclopentyloxy)ethane, 3,4-epoxy-6-methylcyclohexylmethyl-3',4'-epoxy-6'-methylcyclohexane carboxylate and 2-(3,4-epoxy)cyclohexyl-5,5-spiro(3',4'-epoxy)cyclohexane dioxane.

Also eligible are epoxy resins in which the epoxy groups are attached to hetero atoms of different kind, or in which some or all of the epoxy groups are central, for example the N,N,O-triglycidyl derivative of 4-aminophenol, N-glycidyl-N'-(2-glycidyloxypropyl)-5,5-dimethylhydantoin, vinylcyclohexene dioxide, limonene dioxide and dicyclopentadiene dioxide.

As component (c) it is particularly preferred to use diglycidyl ethers or advanced diglycidyl ethers of dihydric phenols in particular diglycidyl ethers or advanced diglycidyl ethers of 2,2-bis(4-hydroxyphenyl)propane, 2,2-bis(3,5-dibromo-4-hydroxyphenyl)-propane, bis(4-hydroxyphenyl)methane, bis(4-hydroxycyclohexyl)-methane or 2,2-bis(4-hydroxycyclohexyl)propane; polyglycidyl ethers of novolaks, or tetraglycidylated 4,4'-diaminodiphenylmethane. Most preferred are diglycidyl ethers or advanced diglycidyl ethers of bisphenol A, tetrabromo-bisphenol A or bisphenol F, polyglycidyl ethers of phenol/formaldehyde or cresol/formaldehyde novolaks, or mixtures thereof, in particular bisphenol A diglycidyl ether with an average molecular weight of 600 to 5,000 daltons.

Suitable hardeners (d) for epoxy resins are in general any epoxy resin hardeners, e.g. cyanamide, dicyandiamide, polycarboxylic acids, polycarboxylic anhydrides, polyamines, polyaminoamides, adducts of amines and polyepoxides, and polyols.

Suitable polycarboxylic acids and their anhydrides are e.g. phthalic anhydride, tetrahydrophthalic anhydride, hexahydrophthalic anhydride, methyltetrahydrophthalic anhydride, methyleneendomethylenetetrahydrophthalic anhydride, endomethylenetetrahydrophthalic anhydride, hexachloroendomethylenetetrahydrophthalic anhydride, trimellitic anhydride, pyromellitic anhydride, maleic anhydride, succinic anhydride, nonenylsuccinic anhydride, dodecenylsuccinic anhydride, polysebacic polyanhydride and polyazelaic polyanhydride as well as the acids pertaining to said anhydrides.

Examples of polyamines which are suitable hardeners are aliphatic, cycloaliphatic, aromatic and heterocyclic polyamines such as ethylenediamine, propane-1,2-diamine, propane-1,3-diamine, N,N-diethylethylenediamine, hexamethylenediamine, diethylenetriamine, triethylenetetramine, tetraethylenepentamine, N-(2-hydroxyethyl)-N-(2-hydroxypropyl)-and N-(2-cyanoethyl)diethylenetriamine, 2,2,4- and 2,4,4-trimethylhexane-1,6-diamine, m-xylylenediamine, N,N-dimethyl- and N,N-diethylpropane-1,3-diamine, bis(4-aminocyclohexyl)methane, 2,2-bis(4-aminocyclohexyl)propane, 2,2-bis(4-amino-3-methylcyclohexyl)propane, 3-aminomethyl-3,5,5-trimethylcyclohexylamine (isophoronediamine), m- and p-phenylenediamine, bis(4-aminophenyl)methane, bis(4-aminophenyl)sulfone, aniline-formaldehyde resins and N-(2-aminoethyl)piperazine. Suitable polyaminoamides are e.g. those which are prepared from aliphatic polyamines and dimerised or trimerised unsaturated fatty acids.

Suitable adducts of amines with polyepoxides are e.g. adducts of aliphatic or cycloaliphatic diamines such as 1,6-hexamethylenediamine, 2,2,4- and 2,4,4-trimethylhexane-1,6-diamine or isophoronediamine with the above-mentioned diglycidyl ethers.

Suitable polyol hardeners (d) are in particular mono- or polynuclear aromatic polyols, including novolaks, such as resorcinol, hydroquinone, 2,6-dihydroxytoluene, pyrogallol, 1,1,3-tris(hydroxyphenyl)-propane, bis(4-hydroxyphenyl)methane, 2,2-bis(4-hydroxyphenyl)propane, bis(4-hydroxyphenyl)sulfone and 4,4'-dihydroxybiphenyl as well as novolaks of formaldehyde or acetaldehyde and phenol, chlorophenol or alkylphenols containing up to 9 carbon atoms in the alkyl moiety, in particular cresol and phenol novolaks.

Preferred hardeners are polycarboxylic anhydrides such as norbornenedicarboxylic anhydride, tetrahydrophthalic anhydride, hexahydrophthalic anhydride and methyltetrahydrophthalic anhydride, as well as aromatic polyamines, in particular bis(4-aminophenyl)methane, bis(4-aminophenyl)sulfone and m- or p-phenylenediamine.

The hardeners (d) are employed in the amounts conventionally used in the art of epoxy resins, and conveniently in such amounts that about 0.7 to 1.5 equivalents of functional groups of the hardener (d) are present per one equivalent of OH and/or glycidyloxy groups.

Compounds which are known per se may also be employed as curing catalysts (d), e.g.: complexes of amines, in particular tertiary amines such as monoethylamine, trimethylamine and octyldimethylamine, with boron trifuloride or boron trichloride, monoesters of aspartic acid, e.g. 4-methyl N-(3-dimethylaminepropyl-)aspartate, and, in particular, unsubstituted or substituted imidazoles such as imidazole, benzimidazole, 1-methylimidazole, 2-ethyl-4-methylimidazole, 2-vinylimidazole, 2-phenylimidazole, 2-phenyl-4-methylimidazole, 1-(2,6-dichlorobenzoyl)-2-phenylimidazole and 1-(2,4,6-trimethylbenzoyl)-2-phenylimidazole. Imidazoles are preferred curing catalysts (d), with 2-phenylimidazole and 2-ethyl-4-methylimidazole being most preferred.

The mixtures of this invention may also contain a curing accelerator in addition to component (d). Suitable accelerators are e.g. tertiary amines such as benzyldimethylamine, tris(dimethylaminomethyl)phenol, hexamethylenetetramine or 1,6-bis(dimethylamino)-hexane; aromatic carbonates such as diphenyl carbonate and urea derivatives such as N-4-chlorophenyl-N',N-dimethylurea (monuron), N-3-chloro-4-methylphenyl-N',N-dimethylurea (chlortoluron) and N-(2-hydroxy-4-nitrophenyl)-N',N-dimethylurea. Tertiary amines are preferred curing accelerators, with benzyldimethylamine being most preferred.

Component (d) and the curing accelerator are employed in the customary effective amounts, i.e. in amounts sufficient for the curing of the mixtures of the invention. The ratio of component (d) to the curing accelerator is determined by the nature of the compounds employed, the required curing rate and the properties desired in the final product and can readily be determined by the person skilled in the art of epoxy resin curing.

The mixtures of the invention may also contain further known additives conventionally employed in the art of epoxy resins. Examples of such additives are: pigments, dyes, reinforcing materials such as glass fibres, flame retardants, reactive diluents for the epoxy resins, e.g. phenyl and cresyl glycidyl ethers, butanediol diglycidyl ethers and hexahydrophthalic acid diglycidyl ethers, antistatic agents, levelling agents, mould release agents, adhesion promoters, antioxidants and light stabilisers.

Depending on their properties, the mixtures of this invention can be employed e.g. as adhesives or for the preparation of moulded articles, cured products, in particular of castings, laminates and thin coatings (films) and unsupported films. Conventional moulding processes are applied, e.g. injection moulding, extrusion or compression moulding processes. To coat surfaces, it is convenient to dissolve the coating of this invention and then, after coating, to remove the solvent by conventional methods. Suitable solvents, which may be employed by themselves or in admixture, are e.g. ketones such as dimethyl ketone, diethyl ketone, methyl isobutyl ketone, cyclohexanone, cyclopentanone, cycloheptanone, isophorone, methoxyhexanone, acetonylacetone, acetophenone, benzyl ethyl ketone, 3,3,5-trimethylcyclohexanone, mesityl oxide; halogenated hydrocarbons such as carbon tetrachloride, chloroform, methylene chloride, methylene bromide, bromochloromethane, 1,2-dichloroethane, 1,1,2-trichloroethane, 1,1,2,2-tetrachloroethane, 1,2,3-trichloropropane, perchloroethylene; alcohols such as methanol, ethanol, propanol, butanol, hexanol, cyclohexanol, furfuryl alcohol, tetrahydrofurfuryl alcohol, benzyl alcohol, monoalkylated glycols such as methyl glycol, ethyl glycol, methyl diglycol, ethyl diglycol, butyl diglycol, triethylene glycol monomethyl ether, triethylene glycol monoethyl ether or triethylene glycol monobutyl ether, glycols such as ethylene glycol, propylene glycol or butylene glycol and oligomers thereof, e.g. triethylene glycol; aliphatic and aromatic hydrocarbons such as pentane, hexane, cyclohexane, methylcyclohexane, benzene, toluene or xylene; ethers such as diethyl ether, dibutyl ether, tetrahydrofuran, dioxane, ethylene glycol dimethyl ether, diethylene glycol dimethyl ether; carboxylates such as methyl acetate, ethyl acetate, propyl acetate, butyl acetate, isopropyl acetate, phenyl acetate, methyl propionate, butyl glycolate, methyl benzoate, ethyl glycol monoacetate, ethyl glycol diacetate, methyl glycol acetate or ethyl glycol acetate; lactones such as butyrolactone or valerolactone; acid amides such as dimethylformamide, dimethylacetamide, hexamethylphosphoric triamide; sulfones such as dimethyl sulfone, dibutyl sulfone or tetramethylene sulfone.

Suitable carrier materials are conventional materials which are preferably electrically non-conductive, e.g. paper, wood, plastics, glass, ceramics and semi-conductors.

The curing of the mixtures of this invention which additionally contain an epoxy resin as binder is generally carried out by heating to temperatures in the range from 80° to 200° C., preferably from 100° to 180° C. The compounds of formula I containing OH or glycidyl groups are thereby incorporated in undestroyed form and finely dispersed into the network of the cured products without impairment of the mechanical properties of said cured products.

Surprisingly, it has been found that by irradiating the mixtures of the invention with actinic light, in particular UV light, finely dispersed elementary zero-valent palladium is liberated therefrom. Suitable light sources are e.g. xenon lamps, argon lamps, tungsten lamps, carbon arcs, metal halide and metal arc lamps such as low-pressure, medium-pressure and high-pressure mercury lamps, argon ion lasers, frequency doubled Nd-YAG lasers (yttrium/aluminium garnet) and UV lasers.

Irradiation may also be effected through a photomask, affording patterns of zero-valent palladium.

The coatings or patterns obtained after irradiation with actinic light are particularly suitable for metal deposition without current, with electrically conductive metallic coatings or patterns being obtained. The metal deposition without current can be carried out with metallisation baths known per se and by conventional methods. Suitable metals are for example copper, nickel, cobalt, silver and tin or cobalt/phosphorus and cobalt/nickel alloys.

The invention also relates to the use of the mixtures of the invention for metal deposition without current, and to a process for metallising surfaces of an electrically non-conductive material by metal deposition without current, which process comprises irradiating a moulded article, a layer of the mixture of this invention in the form of an unsupported film or a layer which has been applied to a carrier material, to liberate zero-valent palladium, and subsequently applying a metallic layer by metal deposition without current in a metal deposition bath.

Patterns of high resolution can be obtained by the process of this invention. Such products can be employed e.g. as printed circuits.

The invention is illustrated in more detail by the following Examples.

A) PREPARATION OF PALLADIUM COMPLEXES

EXAMPLE A

Preparation of tris(dibenzalacetone bis-p,p'-glycidyl ether) palladium (I)

With vigorous stirring, 15 g of $PdCl_2$ are boiled in a solution of 10.7 g of NaCl in 65 ml of water until the palladium chloride is completely dissolved. The water is then distilled off. The residue is taken up in 200 ml of methanol and the solution is heated to 60° C. 105.9 g of dibenzalacetone bis-p,p'-diglycidyl ether and 42.8 g of sodium acetate.$3H_2O$ are added, followed by the addition of another 175 ml of methanol. After a further 15 minutes at 60° C., the mixture is cooled. A precipitate forms which is isolated by filtration under argon and washed with one 100 ml portion of methanol, with three 100 ml portions of water and then with two more 100 ml portions of methanol. The product is subsequently dried in vacuo at 50° C. For the complete removal of the residual dibenzalacetone bis-p,p'-diglycidyl ether, the crystals are suspended in 700 ml of methanol and then isolated by filtration under argon. Subsequent drying in vacuo affords 100.7 g of violet crystals (97% of theory). Decomposition range: 120° to 160° C. Analysis shows that q has a value of 3.2.

EXAMPLE B

Bis(dibenzalacetone) palladium (II)

Preparation is carried out in accordance with J. Chem. Soc. D 1970, 1065.

B) Application Examples

EXAMPLE 1

25 g of a polymer comprising 80 mol % of N-(5-methyl-3-oxa-4-oxo-hexan-5-yl)dimethylmaleimide (X) and 20 mol % of ethyl acrylate are dissolved in 140 ml of cyclohexanone, and 7.11 g of complex II are added. The resultant solution is applied in a 25 μm layer to a polyester sheet, and the solvent is removed in a circulating air oven. The coated sheet is exposed through a photomask to the radiation of a 440 watt medium-pressure mercury lamp for 100 seconds. After exposure, the sheet is treated in a copper deposition bath comprising 12 g/l of $CuSO_4.H_2O$, 8 g/l of ethylenediaminetetraacetic acid, 15 g/l of NaOH and 1 g/l of octylphenol polyethylene glycol ether. A copper image is obtained at the exposed areas.

EXAMPLE 2

Example 1 is repeated but using complex I instead of complex II. The same result is achieved.

EXAMPLE 3

Example 1 is repeated. After exposure, the sheet is additionally developed in 1,1,1-trichloroethane. A relief image is obtained from the photopolymerised polymer X which image is copper-plated by treatment in a copper deposition bath.

EXAMPLE 4

0.75 g of complex I is dissolved together with 5 g of a bisphenol A diglycidyl ether which has been advanced with bisphenol A (epoxide equivalent weight of the advanced diglycidyl ether: 0.69 mole epoxide/kg), 0.75 g of cis-polybutadiene (mol.wt. =25,000 daltons, functionalised with carboxyl groups) and 0.75 g of norbornenedicarboxylic anhydride in 15 ml of cyclohexanone. This solution is applied in 15 μm films to a polyester sheet. The films are dried for 1 hour at 80° C. in a circulating air oven and cured for 3 hours at 110° C. The cured film is exposed through a photomask to the light of a 5 kilowatt mercury lamp for 200 seconds. After treatment in a copper deposition bath in accordance with the procedure of Example 1, a glossy copper image is obtained.

What is claimed is:

1. A process for the metallization of a surface of an electrically non-conductive material which comprises (1) applying a coating to the surface to be metallized, said coating consisting essentially of a mixture of (a) at least one non-volatile olefinically unsaturated organic material selected from the group consisting of (i) an alkene of 5 to 20 carbon atoms, (ii) a cycloalkene of 5 to 23 carbon atoms, (iii) an unsaturated alcohol of 3 to 12 carbon atoms, (iv) an unsaturated carboxylic acid of 3 to 30 carbon atoms and from 1 to 3 carboxy groups, (v) an amide of said unsaturated carboxylic acid, said amide being unsubstituted or substituted on the amide nitrogen atom by one or two alkyl groups each of 1 to 12 carbon atoms, (vi) an imide of said unsaturated carboxylic acid, said imide being unsubstituted or substituted on the imide nitrogen atom by alkyl of 1 to 12 carbon atoms, (vii) an ester of said unsaturated carboxylic acid and of an alcohol of 1 to 12 carbon atoms and 1 to 3 hydroxy groups, (viii) an anhydride of said unsaturated carboxylic acid, (ix) polybutadiene, (x) polyisoprene, (xi) an unsaturated polyester, and (xii) a polymer having olefinic unsaturated pendant groups; and (b) at least one palladium complex of the formula:

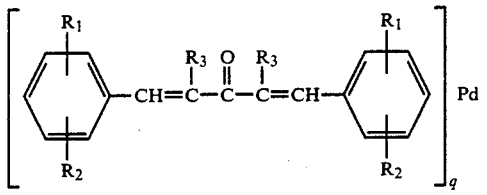

in which each of $R_1$ and $R_2$, independently of the other, is hydrogen, alkyl of 1 to 4 carbon atoms, alkoxy of 1 to 4 carbon atoms, halo, aryl of 6 to 10 carbon atoms, aralkyl of 7 or 8 carbon atoms or alkaryl of 7 or 8 carbon atoms, or $R_1$ is $-(OC_mH_{2m})n-OH$, $-OCH_2CHOHCH_2OH$, or

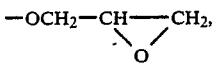

in which m has a value of from 2 to 6 and n has a value of from 0 to 20; and $R_2$ is as herein defined;

each $R_3$ when taken independently is hydrogen or alkyl of 1 to 4 carbon atoms, both $R_3$ groups taken together are ethano, trimethylene or tetramethylene, and q is a rational number of from 1 to 3.5;

the ratio of the unsaturated organic material (a) to the palladium complex (b) being from 100:1 to 1:20;

(2) irradiating at least an area of said coating on said surface with actinic light at least until zero-valent palladium is liberated; and (3) thereafter applying a metallic layer to those portions of the coating in which zero-valent palladium has been liberated by subjecting said surface coating to a metal deposition bath without current.

2. The process according to claim 1 wherein q has a value of from 2 to 3.5.

3. The process according to claim 1 wherein each of $R_2$ and $R_3$ is hydrogen.

4. The process according to claim 3 wherein each $R_1$ is hydrogen or each $R_1$ is hydroxy or glycidyloxy in the para position of the depicted benzene rings.

5. The process according to claim 1 wherein said non-volatile organic material is (i) a maleate, maleic anhydride, maleimide or maleamide unsubstituted or substituted with alkyl of 1 to 4 carbon atoms, (ii) an acrylate, methacrylate, acrylamide or methacrylamide, (iii) an allyl ether or allylamide, (iv) a polymaleate, polybutadiene, or polyisoprene, or (v) a polyolefinic containing dimethylmaleimide as pendant groups.

6. The process according to claim 1 wherein said non-volatile organic material is polybutadiene or polyisoprene having a molecular weight of from 5,000 to 40,000 and functionalized with amino, hydroxy or carboxy groups.

7. The process according to claim 1 wherein said mixture additionally includes a binder.

8. The process according to claim 7 wherein said mixture contains from 40% to 99.8% by weight of binder.

9. The process according to claim 7 wherein said binder is a thermosetting or thermoplastic polymer.

10. The process according to claim 9 wherein said binder is an epoxy resin, an unsaturated polyester, polyacrylate, polymethacrylate, polyimide, polyurethane, polyolefin, polyamide or polyester.

11. The process according to claim 10 wherein said binder comprises one or more epoxyresins.

12. The process according to claim 11 wherein said mixture contains a hardening agent.

13. The process according to claim 12 wherein said binder is bisphenol A diglycidyl ether having an average molecular weight of from 600 to 5,000 Daltons and the hardening agent is a polycarboxylic anhydride or aromatic polyamine.

* * * * *